US010113821B1

(12) United States Patent
Pavlick

(10) Patent No.: US 10,113,821 B1
(45) Date of Patent: Oct. 30, 2018

(54) PISTOL TRIGGER SYSTEMS AND METHODS

(71) Applicant: Nous Defions, LLC, Santa Rosa Beach, FL (US)

(72) Inventor: David Pavlick, Santa Rosa Beach, FL (US)

(73) Assignee: Nous Defions, LLC, Freeport, FL (US)

( * ) Notice: Subject to any disclaimer, the term of this patent is extended or adjusted under 35 U.S.C. 154(b) by 230 days.

(21) Appl. No.: 15/051,751

(22) Filed: Feb. 24, 2016

Related U.S. Application Data

(60) Provisional application No. 62/120,295, filed on Feb. 24, 2015.

(51) Int. Cl.

| | |
|---|---|
| ***F41A 19/00*** | (2006.01) |
| ***F41A 19/10*** | (2006.01) |
| ***F41C 23/10*** | (2006.01) |
| ***F41C 3/00*** | (2006.01) |
| ***F41A 17/46*** | (2006.01) |

(52) U.S. Cl.
CPC ..... *F41A 19/10* (2013.01); *F41A 17/46* (2013.01); *F41C 3/00* (2013.01); *F41C 23/10* (2013.01)

(58) Field of Classification Search
USPC ..... 42/69.01, 69.02, 16, 42.01
See application file for complete search history.

(56) References Cited

U.S. PATENT DOCUMENTS

| | | | | |
|---|---|---|---|---|
| 4,893,546 A * | 1/1990 | Glock | F41A 5/04 89/145 |
| 5,402,593 A * | 4/1995 | Lenkarski | F41A 17/22 42/70.06 |
| 6,588,136 B2 * | 7/2003 | Baker | F41A 19/48 42/70.02 |
| 9,046,313 B1 * | 6/2015 | Lutton | F41A 17/46 |
| 9,073,563 B2 * | 7/2015 | Middleton | B26B 7/00 |

* cited by examiner

*Primary Examiner* — J. Woodrow Eldred
(74) *Attorney, Agent, or Firm* — Snell & Wilmer L.L.P.

(57) ABSTRACT

Exemplary trigger systems reduce trigger slop in polymer-framed pistols. Via use of an oil-impregnated bushing, stacked tolerances are reduced and/or eliminated, leading to improved trigger feel and function.

18 Claims, 6 Drawing Sheets

PISTOL TRIGGER SYSTEMS AND METHODS

CROSS REFERENCE TO RELATED APPLICATIONS

This application claims priority to and the benefit of U.S. Provisional Patent Application Ser. No. 62/120,295 filed Feb. 24, 2015 entitled "PISTOL TRIGGER", which is incorporated by reference in its entirety for all purposes.

TECHNICAL FIELD

The present disclosure relates to firearm triggers, and more specifically, to a trigger system for a polymer-frame pistol.

SUMMARY

In an exemplary embodiment, a polymer-frame pistol comprises a handle portion, a slide coupled to the handle portion, a barrel disposed in the slide, a firing mechanism disposed in the slide and aft of the barrel, and a trigger system comprising a trigger bar and a trigger assembly coupled to the trigger bar forward of the trigger bar. The trigger assembly comprises a trigger body, a through hole, and an oil-impregnated bushing, the oil-impregnated bushing being disposed through the through hole.

In another exemplary embodiment, a firearm trigger assembly for a polymer-frame firearm comprises a trigger body comprising a through hole and an oil-impregnated bushing disposed within the through hole, a spring coupled to the trigger body, and a safety rotatably coupled to the trigger body. The safety is configured to engage the spring in response to the trigger assembly being engaged by a user.

In another exemplary embodiment, a firearm trigger system comprises a trigger bar, and a trigger assembly coupled to the trigger bar forward of the trigger bar. The trigger assembly comprises a trigger body configured with through hole, and an oil-impregnated bushing disposed within the through hole.

In yet another exemplary embodiment, a method for modifying a polymer-frame pistol, the method comprises removing, from the polymer-frame pistol, the stock trigger assembly, and installing, in the polymer-frame pistol, an aftermarket trigger assembly. The aftermarket trigger assembly comprises a trigger body configured with a through hole, and an oil-impregnated bushing disposed in the through hole.

The contents of this summary section are provided only as a simplified introduction to the disclosure, and are not intended to be used to limit the scope of the appended claims.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice principles of the present disclosure, it should be understood that other embodiments may be realized and that logical, chemical and mechanical changes may be made without departing from the spirit and scope of the present disclosure. Thus, the detailed description herein is presented for purposes of illustration only and not of limitation. For example, the steps recited in any of the method or process descriptions may be executed in any order and are not necessarily limited to the order presented. Furthermore, any reference to a singular component or step may include the plural, and any reference to more than one component or step may include a singular component or step. Also, any reference to attached, fixed, connected or the like may include permanent, removable, temporary, partial, full and/or any other possible attachment option. Additionally, any reference to without contact (or similar phrases) may also include reduced contact or minimal contact.

Different cross-hatching and/or surface shading may be used throughout the figures to denote different parts, but not necessarily to denote the same or different materials. The features and elements disclosed herein may be combined in various combinations without exclusivity, unless expressly indicated herein otherwise. These features and elements, as well as the operation of the disclosed embodiments, will become more apparent in light of the following description and accompanying drawings.

For the sake of brevity, conventional techniques for firearms construction, maintenance, modification, and/or the like may not be described in detail herein. Furthermore, the connecting lines shown in various figures contained herein are intended to represent exemplary functional relationships and/or physical couplings between various elements. It should be noted that many alternative or additional functional relationships or physical connections may be present in a practical firearms trigger system.

As may be used herein, "aft" refers to the direction associated with the rear (e.g., the back end) of a firearm, or generally, to the direction of recoil when a firearm discharges a projectile. As used herein, "forward" refers to the direction associated with the muzzle (e.g., the front end) of a firearm, or generally, to the direction of flight or motion of a projectile that has been discharged from the firearm.

Figure 1A:
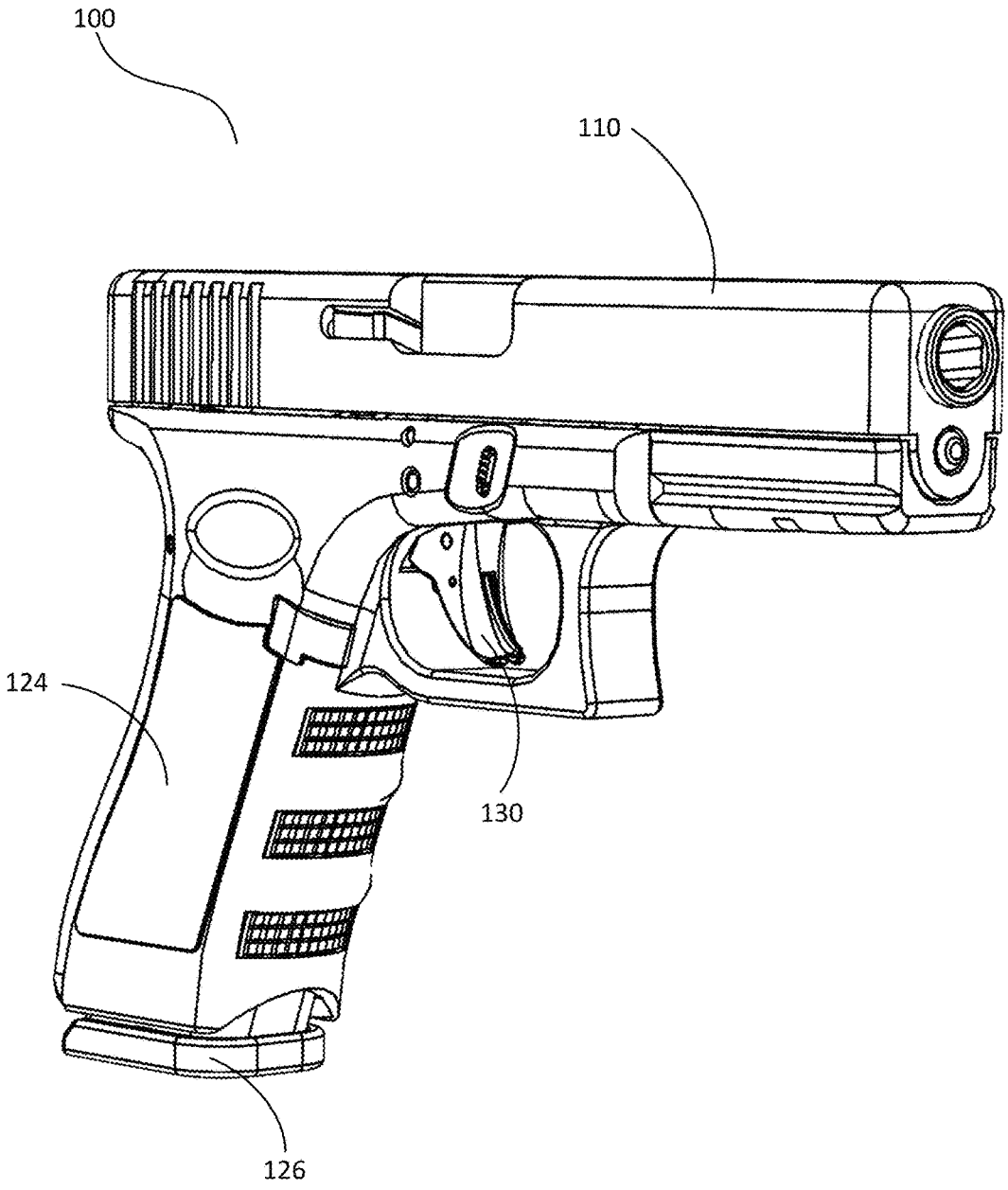
FIG. 1A illustrates a perspective view of an exemplary firearm, in accordance with various embodiments.
Figure 1B:
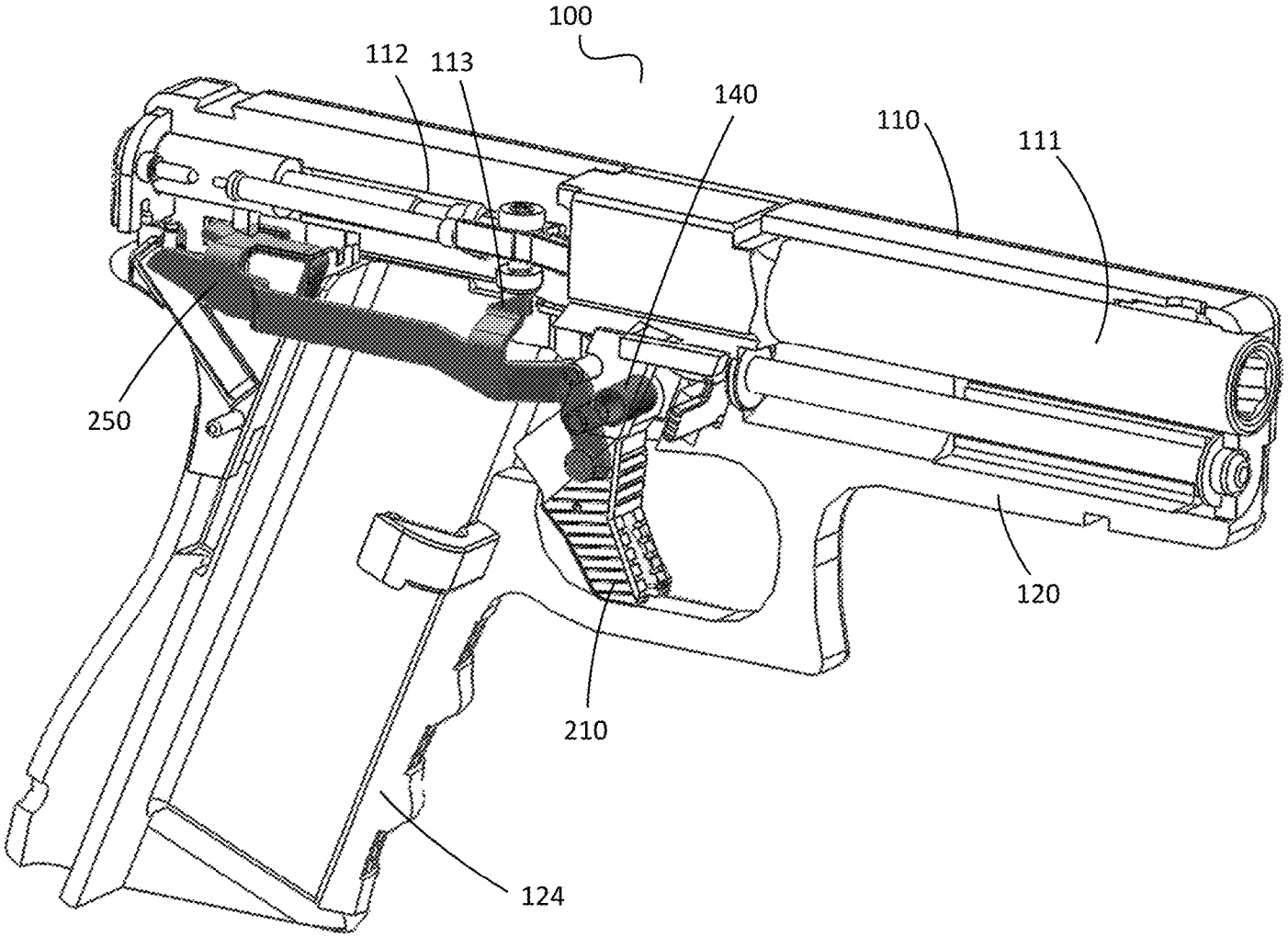
FIG. 1B illustrates a cross-sectional view of an exemplary firearm configured with an exemplary trigger system, in accordance with various embodiments.
Figure 2A:
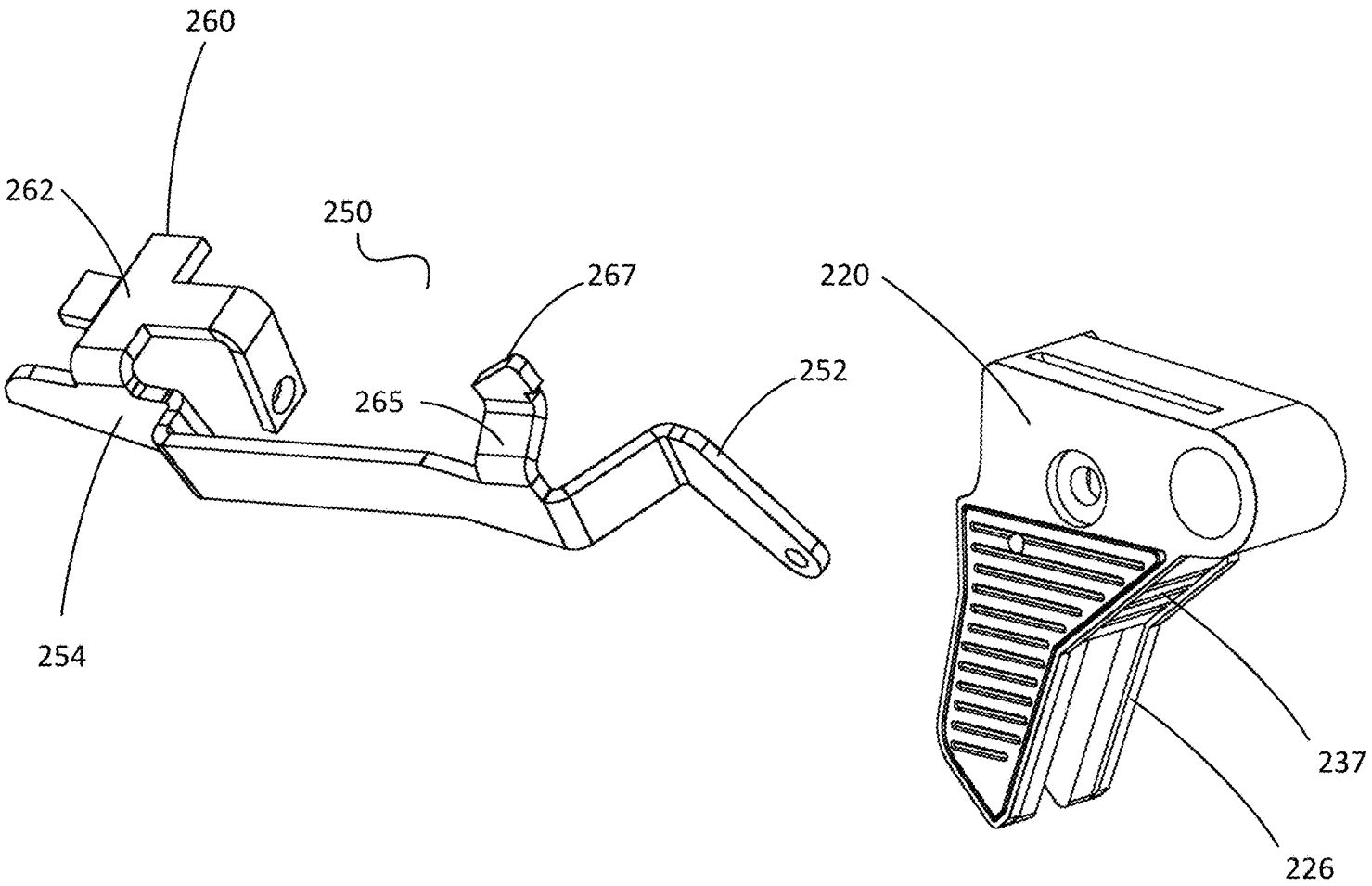
FIG. 2A illustrates components of an exemplary trigger system, in accordance with various embodiments.
Figure 2B:
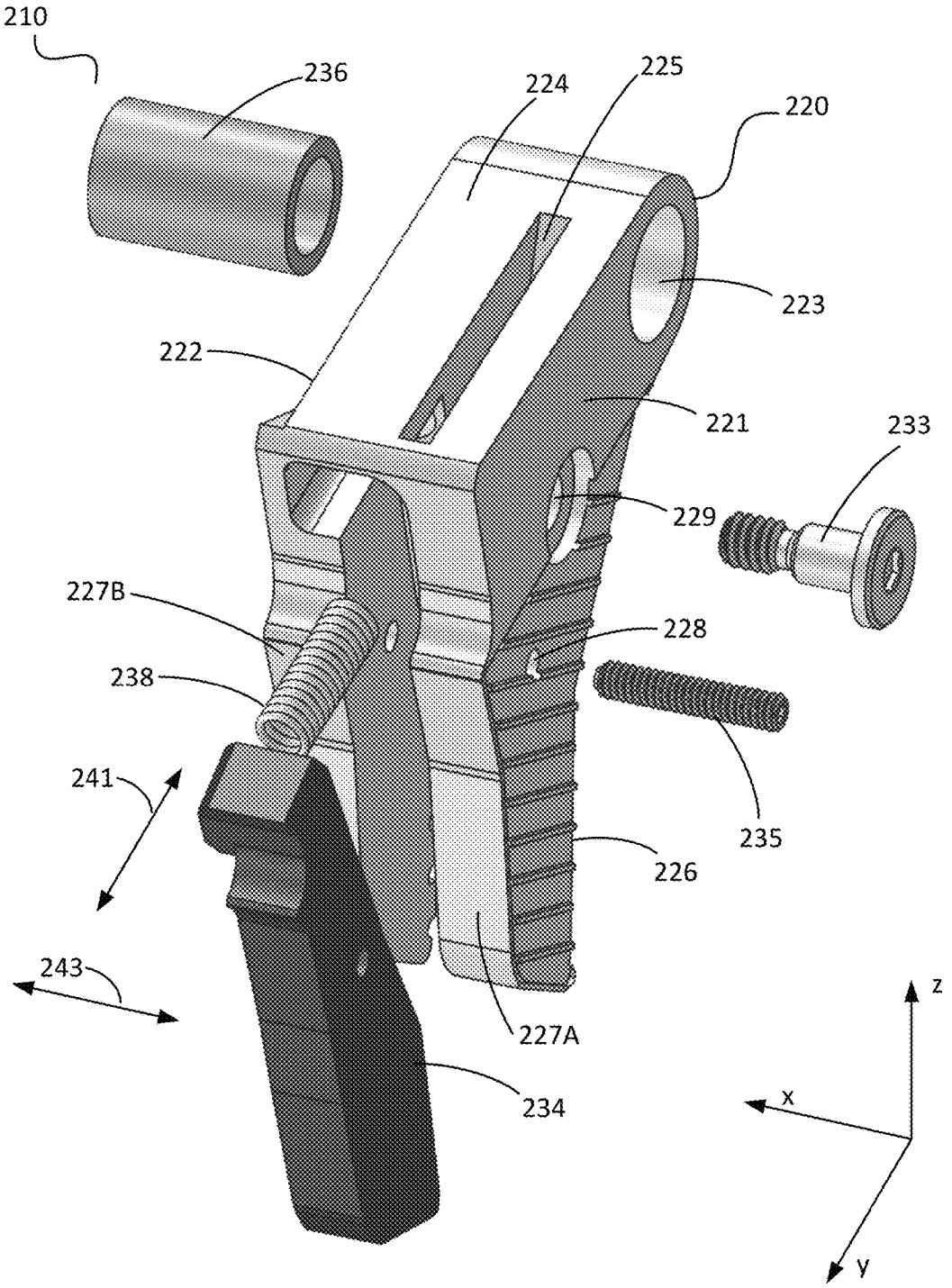
FIG. 2B illustrates an exploded perspective view of an exemplary trigger assembly, in accordance with various embodiments.
Figure 2C:
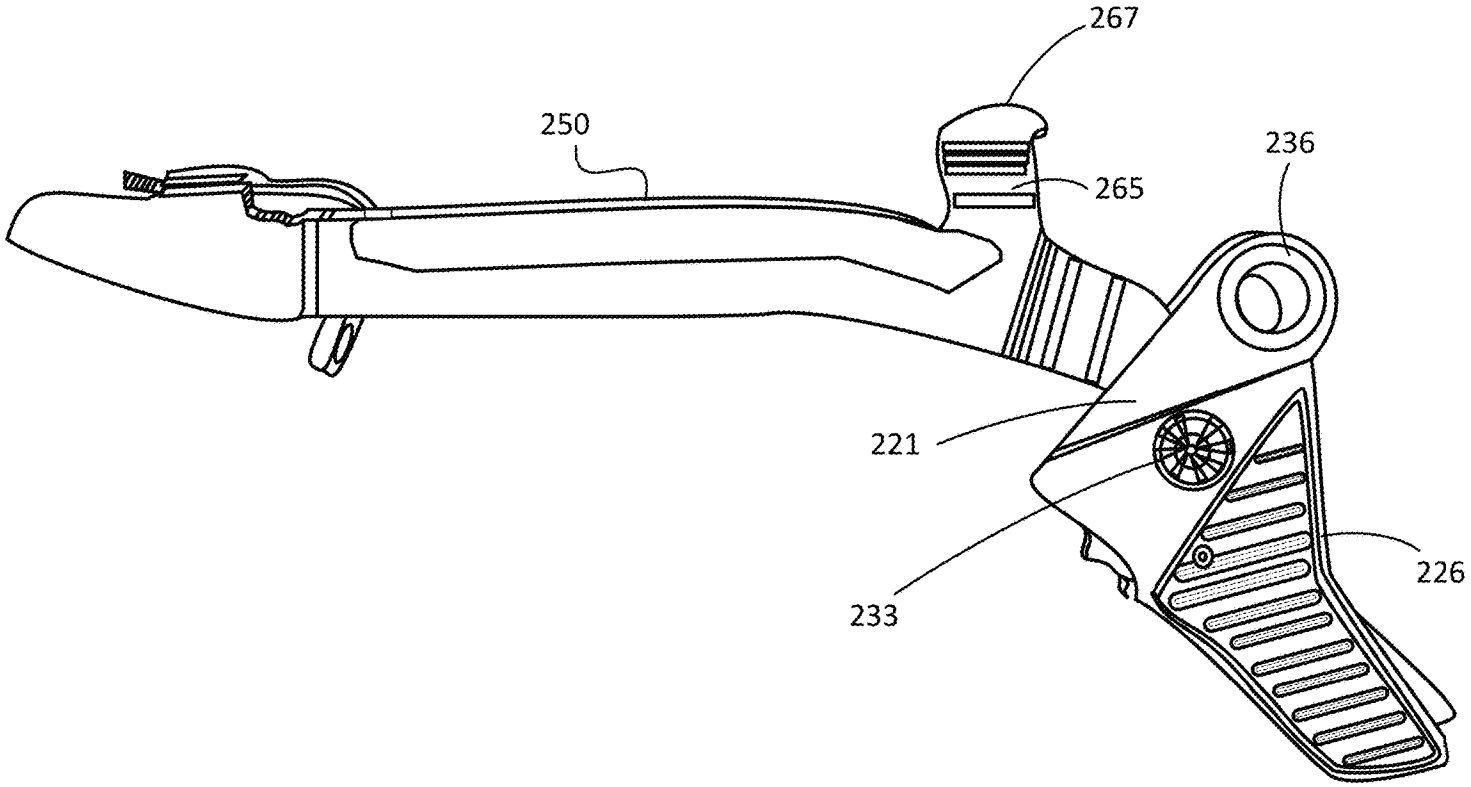
FIGS. 2C and 2D illustrate components of an exemplary trigger system, in accordance with various embodiments.
Figure 2D:
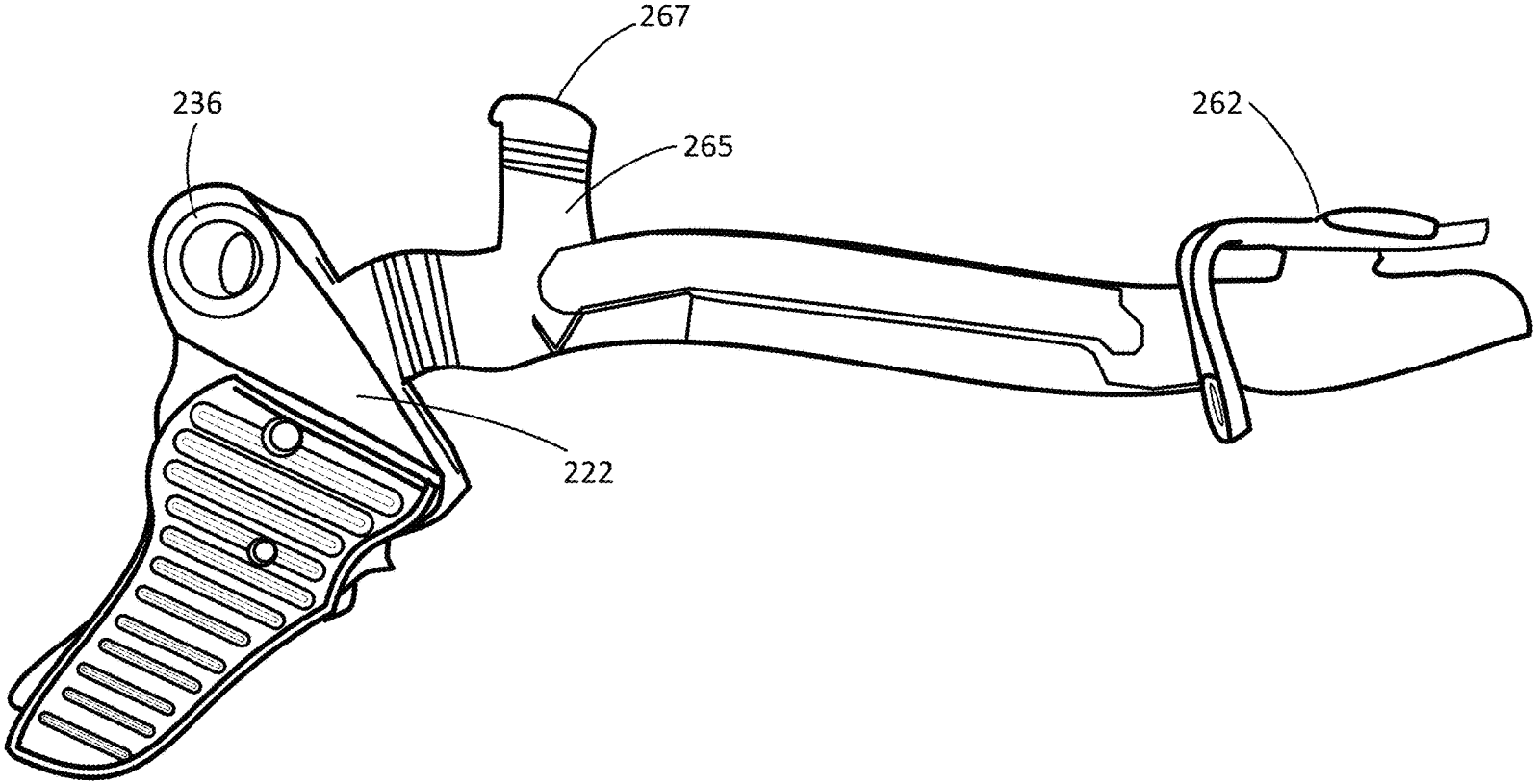

In various embodiments and with reference to FIG. 1A and FIG. 1B, a firearm 100 comprises a slide 110 and a handle portion 120 coupled to slide 110. Handle portion 120 comprises a handle 124 defining a channel configured to receive a magazine 126. Moreover, handle portion 120 may be configured to receive stock trigger 130, which may be replaced and/or upgraded with a trigger system 200. Trigger system 200 comprises a trigger assembly 210 and a trigger bar 250. Trigger bar 250 may be operatively coupled to trigger assembly 210. Trigger bar 250 may be configured to contact, engage, and/or operate a firing mechanism 112. Firing mechanism 112 may be disposed in slide 110. Moreover, firing mechanism 112 may be configured to engage a round of ammunition and fire the round of ammunition through a barrel 111 disposed in and/or coupled to slide 110.

Certain prior trigger systems, for example certain trigger systems provided as original manufacturer equipment on various polymer-frame firearms, suffer from various deficiencies. For example, stacked tolerances lead to trigger slop (for example, lateral movement/play in the trigger). Additionally, due to rotation of trigger components about a pivot point during operation, the trigger system is not a true "flat-pull" trigger, leading to sub-optimal trigger feel and response.

In contrast, these and other deficiencies of prior trigger systems may be remedied via application of principles of the present disclosure. In a polymer-frame pistol, trigger slop may be reduced and/or eliminated. Additionally, trigger movement may more closely approximate a "flat-pull" trigger, leading to improved trigger feel, response, and shooter form.

In various embodiments, with reference now to FIGS. 2A through 2D, trigger assembly 210 comprises a trigger body 220, a bushing 236, a spring 238, a safety 234, a rod 235, and/or a fastener 233.

In various embodiments, trigger body 220 comprises a metal such as aluminum or an aluminum alloy. In one exemplary embodiment, trigger body 220 is formed from 7075 T-6 aluminum. In various embodiments, trigger body 220 comprises a first side 221, a second side 222, a trigger body top side 224, a contact side 226, a first flange 227A, and/or a second flange 227B. Trigger body 220 may further comprise a through hole 223 through trigger body 220 spanning between first side 221 and second side 222. Through hole 223 may be configured to receive and/or house bushing 236, which may have a complementary shape to that of through hole 223. Bushing 236 may be any suitable bushing including, for example, an oil-impregnated metal bushing, and/or any other suitable bushing. In one exemplary embodiment, bushing 236 comprises an oil-impregnated bronze alloy. During assembly of trigger body 220, bushing 236 may be cooled, causing bushing 236 to shrink so that it may be installed with an interference fit in through hole 223. By reducing the effect of stacked tolerances, bushing 236 may cause trigger assembly 210 to be moveable only in a forward-aft direction 241 along a Y-axis, and thus reduce and/or prevent movement in lateral direction 243 by trigger assembly 210 along an X-axis. Trigger body 220 may further comprise a trigger body slit 225 through trigger body top side 224 configured to operatively couple to a trigger bar forward portion 252.

In various embodiments and with continued reference to FIGS. 2A through 2D, contact surface 226 comprises one or more recesses 237. The recesses may provide texture to improve engagement of the trigger in response to operation of firearm 100. The one or more recesses 237 may be disposed laterally across contact surface 226 of trigger body 220.

In various embodiments, contact surface 226 of trigger body 220 is configured with a "lazy-L" shape, meaning that an angle between two portions of the shape is between 90 degrees and 180 degrees. In various exemplary embodiments, contact surface 226 is configured with a lazy-L shape having an angle of between about 145 degrees and about 165 degrees. In one exemplary embodiment, contact surface 226 is configured with a lazy-L shape having an angle of about 155 degrees.

As compared to certain prior trigger bodies configured with a flat face or a curved shape, trigger body 220 is configured with contact surface 226 having a lazy-L shape, allowing for increased mechanical advantage when shooting. When trigger body 220 is utilized in the operation of a pistol, the trigger finger begins at an exaggerated angle of flexion and finishes at a flat angle due to the lazy-L shape of contact surface 226. In contrast, flat-faced triggers do the exact opposite; flat-faced triggers start flat and when fully depressed, result in the finger being positioned at an off angle. Consequently, these flat-faced triggers do not offer a mechanical advantage and, to improve feel, are thus often reduced in weight as compared to stock trigger systems; this weight reduction can be a safety hazard as discussed below. In contrast, trigger body 220 configured with a lazy-L contact surface 226 encourages proper trigger pull through positive reinforcement (being more ergonomic and thus more comfortable) while utilizing mechanical advantage to make the trigger pull "feel" lighter than the actual trigger pull weight, for example between about 0.5 pounds and 1.5 pounds lighter. In one exemplary embodiment, use of trigger body 220 results in a trigger pull weight of 4.5 pounds feeling equivalent to a trigger pull weight of 3.5 pounds due to mechanical advantage.

Additionally, in various exemplary embodiments use of trigger body 220 allows for increased safety. Various prior trigger systems utilized lightened trigger pull weights as compared to stock trigger pull weights, for example trigger pull weights below 4.5 pounds. A low trigger pull weight increased the risk of accidental and/or unintentional discharge. In contrast, in various exemplary embodiments trigger body 220 is configured to maintain a stock trigger pull weight, for example a trigger pull weight of about 4.5 pounds. In this manner, trigger body 220 maintains a stock trigger pull weight for firearm 100, which is generally accepted as safe for carry and/or duty use. Stated another way, use of trigger body 220 in a firearm 100 provides improved feel without compromising safety.

In various embodiments, trigger body 220 and, more specifically bushing 236, may be matched to and configured to receive a trigger pin (e.g., a shaft), for example a stock trigger pin. The trigger pin may be a machined and/or precision ground pin. The trigger pin may be configured to be installed within and operatively rotate within bushing 236 (stated another way, bushing 236 may be permitted to rotate about the trigger pin). In this regard, the trigger pin may be configured to create a bearing interface between bushing 236 and trigger body 220, wherein trigger body 220 may rotate with bushing 236 and about the trigger pin. Moreover, this assembly may define the movement of trigger assembly 210 within handle portion 120, for example as shown in FIG. 1B. This arrangement (i.e., interface) may reduce or eliminate the movement in lateral direction 243 of trigger body 220 along the X-axis. Moreover, the arrangement of the trigger pin with respect to trigger body 220 and bushing 236 may allow trigger body 220 to translate in forward-aft direction 241 along the Y-axis, in response to operation and/or engagement by a user of trigger assembly 210.

Via use of bushing 236, together with tighter tolerances associated with trigger body 220 as compared to prior systems, various undesirable operational characteristics of prior trigger systems can be reduced and/or eliminated. For example, lateral torsion associated with an OEM trigger for a polymer-frame pistol may be eliminated. Additionally, trigger "slop" generally may be reduced. In this manner, operation of a polymer-frame pistol configured with trigger assembly 210 may be improved.

In various embodiments, spring 238 may be operatively installed in and contained within trigger body 220 between first flange 227A and second flange 227B. In this regard, spring 238 may be configured to engage and/or operate against a portion of safety 234 in response to the trigger system being engaged by a user. In various embodiments, safety 234 may be rotatably coupled to trigger body 220 via a rod 235 passing through a rod channel 228. Rod 235 may be threaded. Safety 234 may be disposed in trigger body 220 between first flange 227A and second flange 227B. Rod channel 228 may span between first side 221 and second side 222 and through first flange 227A and second flange 227B. Rod 235 may engage and positively retain safety 234 such that safety 234 may be capable of translating in forward-aft direction 241 along a Y-axis when engaged by a user. Safety 234 may be restrained from moving in a lateral direction 243 along an X-axis by rod 235 being installed through rod channel 228.

In various embodiments, trigger bar 250 comprises a trigger bar forward portion 252 and a trigger bar aft portion 254. A fin 265 may protrude from trigger bar 250, between trigger bar forward portion 252 and trigger bar aft portion 254, and toward slide 110. Fin 265 comprises a fin end 267, which may be arcuate. Fin end 267, in response to operation of firearm 100, may be configured to contact a firing mechanism safety 113 (depicted in FIG. 1B). In various exemplary embodiments, the arcuate shape of fin end 267 makes contact between fin end 267 and firing mechanism safety 113 smoother (as compared to other shapes for fin end 267); however, it is not outside the scope of this disclosure for fin end 267 to comprise any suitable shape. It will be appreciated that use of an arctuate fin end 267 (and/or modification of a stock trigger bar to be configured with an arctuate fin end 267) increases surface area contact with a common rounded "button head" of the firing pin safety, while decreasing the "gritty" pull or "bump" sensation when pulling an OEM trigger, due to uneven angles and rough edges left over from the stamping process.

In various embodiments, trigger assembly 210 may be operatively coupled to trigger bar forward portion 252. Trigger body slit 225 may be configured to receive trigger bar forward portion 252. Fastener 233 may be installed through fastener channel 229, fastener channel 229 being disposed through trigger body 220, and fasten trigger bar forward portion 252 to trigger body 220. Fastener 233 may be any suitable fastener configured to retain trigger bar 250 within trigger body 220. Moreover, fastener 233 may be configured to restrain, reduce, and/or eliminate any lateral movement, for example movement in lateral direction 243 along the X-axis by trigger bar 250. In this regard, trigger bar 250 may be configured to translate along forward-aft direction 241 along the Y-axis. This motion may be configured to actuate firing mechanism 112 as shown in FIG. 1B.

In various embodiments, trigger bar aft portion 254 comprises a cruciform 260 configured to contact, engage, and/or operate firing mechanism 112 when a user engages trigger assembly 210 to operate firearm 100. Cruciform 260 comprises a cruciform top portion 262. Cruciform top portion 262 may be substantially flat, which enables up to about 90% of cruciform top portion 262 to contact firing mechanism 112. As used in this context, the term "about" is intended to mean a range of plus or minus 10%. The substantially flat configuration allows cruciform top portion 262 to have increased contact with firing mechanism 112 as compared to traditional configurations of the trigger bar within a trigger system (for example, certain stock firearm trigger bars offer only about 30% contact with a firearm firing mechanism). A greater percentage of contact between cruciform 260 and firing mechanism 112 allows for more effective and consistent operation of firearm 100. The flat surface of cruciform top portion 262 creates a more supported firing pin/striker during the cocking process and release. This makes for a crisp and definitive trigger pull "wall" and break, as compared to the rolling break that a stock trigger and some aftermarket triggers create. Application of principles of the present disclosure results in more mechanically sound, enhanced tactile feel for the end user.

It will be appreciated that trigger bar 250 as configured herein may comprise an aftermarket part for a firearm; alternatively, trigger bar 250 as configured herein may be created via modification of a stock trigger bar provided with a polymer-frame firearm.

Trigger assembly 210 may be installed as an aftermarket product in various polymer-frame pistols, for example pistols offered by Glock GmbH (Deutsch-Wagram, Austria) and/or the like. In this manner, operation of a polymer-frame pistol may be made more reliable, more repeatable, and with improved shooter feel and form.

In exemplary embodiment, a method for modifying a polymer-frame pistol comprises removing, from the polymer-frame pistol, the stock trigger assembly; and then installing, in the polymer-frame pistol, an aftermarket trigger assembly. The aftermarket trigger assembly comprises a trigger body configured with a through hole and an oil-impregnated bushing disposed in the through hole as disclosed above.

While various exemplary embodiments discussed herein have been in the context of polymer-frame pistols, it will be appreciated that such embodiments have been discussed by way of example and not of limitation, and that the principles of the present disclosure are applicable to firearms of various types and constructed from a wide variety of materials.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions. The scope is accordingly to be limited by nothing other than the appended claims, in which reference to an element in the singular is not intended to mean "one and only one" unless explicitly so stated, but rather "one or more." Different cross-hatching is used throughout the figures to denote different parts but not necessarily to denote the same or different materials.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. While the principles of this disclosure have been shown in various embodiments, many modifications of structure, arrangements, proportions, the elements, materials and components, used in practice, which are particularly adapted for a specific environment and operating requirements may be used without departing from the principles and scope of this disclosure. These and other changes or modifications are intended to be included within the scope of the present disclosure and may be expressed in the following claims.

The present disclosure has been described with reference to various embodiments. However, one of ordinary skill in the art appreciates that various modifications and changes can be made without departing from the scope of the present disclosure. Accordingly, the specification is to be regarded in an illustrative rather than a restrictive sense, and all such modifications are intended to be included within the scope of the present disclosure. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element of any or all the claims.

When language similar to "at least one of A, B, or C" or "at least one of A, B, and D" is used in the claims, the phrase is intended to mean any of the following: (1) at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C.

What is claimed is:

1. A polymer-frame pistol, comprising:

a handle portion;

a slide coupled to the handle portion;

a barrel disposed in the slide;

a firing mechanism disposed in the slide and aft of the barrel; and a trigger system comprising a trigger bar and a trigger assembly coupled to a trigger bar forward portion of the trigger bar, wherein the trigger assembly comprises a trigger body, a through hole, and an oil-impregnated bushing, the oil-impregnated bushing being disposed through the through hole, and wherein the trigger bar comprises a cruciform on a trigger bar aft portion, the cruciform having a cruciform top portion that is substantially flat.

2. The pistol of claim 1, further comprising a pin disposed through the oil-impregnated bushing, the pin being configured to allow the trigger body to rotate with the oil-impregnated bushing and about the pin, wherein an interface between the pin and the oil-impregnated bushing eliminates lateral movement of the trigger assembly.

3. The pistol of claim 1, wherein the trigger body comprises at least one of aluminum or an aluminum alloy.

4. The pistol of claim 1, wherein the oil-impregnated bushing comprises a bronze alloy.

5. The pistol of claim 1, wherein at least 50% of the cruciform op portion engages the firing mechanism.

6. The pistol of claim 1, wherein the trigger bar comprises a fin protruding from the trigger bar, the fin being configured to contact a firing mechanism safety in response to the trigger being engaged by a user.

7. The pistol of claim 1, wherein the trigger body comprises a trigger body slit, and wherein the trigger bar forward portion is disposed within the trigger body slit.

8. The pistol of claim 1, wherein the trigger assembly further comprises:

a spring coupled to the trigger body; and a safety rotatably coupled to the trigger body configured to engage the spring in response the trigger system being engaged by a user.

9. A firearm trigger system, comprising:

a trigger bar comprising a cruciform on a trigger bar aft portion, the cruciform having a cruciform top portion that is substantially flat; and a trigger assembly coupled to a trigger bar forward portion of the trigger bar, the trigger assembly comprising:

a trigger body comprising a through hole; and an oil-impregnated bushing disposed within the through hole.

10. The firearm trigger system of claim 9, wherein the trigger bar comprises a fin protruding from the trigger bar, and wherein the fin comprises an arcuate fin end.

11. The firearm trigger system of claim 9, further comprising a safety rotatably coupled to the trigger body and a spring disposed in the trigger body, wherein the safety is configured to engage the spring in response to the trigger system being engaged by a user.

12. The pistol of claim 1, wherein the trigger body comprises a contact surface having a first portion and a second portion, and wherein an angle between the first portion and the second portion is between 145 degrees and 165 degrees.

13. The pistol of claim 6, wherein the fin comprises an arcuate fin end.

14. The pistol of claim 8, wherein the safety is coupled to the trigger body between a first flange and a second flange of the trigger body.

15. The pistol of claim 1, wherein the trigger body comprises a trigger pull weight for the pistol of about 4.5 pounds.

16. The firearm trigger system of claim 11, wherein the safety is coupled to the trigger body between a first flange and a second flange of the trigger body.

17. The firearm trigger system of claim 9, wherein the trigger body comprises a contact surface having a first portion and a second portion, and wherein an angle between the first portion and the second portion is between 145 degrees and 165 degrees.

18. The firearm trigger system of claim 9, wherein the trigger body comprises a trigger body slit, and wherein the trigger bar forward portion is disposed within the trigger body slit.

* * * * *